US011413773B1

(12) United States Patent
Chen et al.

(10) Patent No.: US 11,413,773 B1
(45) Date of Patent: Aug. 16, 2022

(54) UTILITY KNIFE

(71) Applicants: MING SHIN TOOLS CO., LTD., Taichung (TW); Yung-Shun Chen, Taichung (TW); Cheng-Chou Wu, Taichung (TW)

(72) Inventors: Yung-Shun Chen, Taichung (TW); Cheng-Chou Wu, Taichung (TW)

(73) Assignees: Ming Shin Tools Co., Ltd., Taichung (TW); Yung-Shun Chen, Taichung (TW); Cheng-Chou Wu, Taichung (TW)

( * ) Notice: Subject to any disclaimer, the term of this patent is extended or adjusted under 35 U.S.C. 154(b) by 2 days.

(21) Appl. No.: 17/156,070

(22) Filed: Jan. 22, 2021

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01)

(58) Field of Classification Search
CPC ..... B26B 1/08; B26B 5/001; B26B 5/003
See application file for complete search history.

(56) References Cited

U.S. PATENT DOCUMENTS 3,577,637 A * 5/1971 Braginetz ..... B26B 5/001 30/162
3,593,417 A * 7/1971 West ..... B26B 5/001 30/125
5,644,843 A * 7/1997 Young ..... B26B 5/001 30/162
6,330,749 B1 * 12/2001 Khachatoorian ..... B26B 5/001 30/162
6,454,427 B1 * 9/2002 Chen ..... B26B 5/001 362/120
8,793,881 B2 * 8/2014 Rowlay ..... B26B 5/001 30/162
9,205,569 B2 * 12/2015 Garavaglia ..... B26B 1/10
10,252,428 B2 * 4/2019 Ranieri ..... B26B 1/08
2006/0010694 A1 * 1/2006 Chen ..... B26B 5/001 30/162
2007/0220758 A1 * 9/2007 Ho ..... B26B 5/001 30/162

FOREIGN PATENT DOCUMENTS

TW I309197 B 5/2009
TW M478597 U 5/2014

* cited by examiner

*Primary Examiner* — Hwei-Siu C Payer
(74) *Attorney, Agent, or Firm* — Muncy, Geissler, Olds & Lowe, P.C.

(57) ABSTRACT

A utility knife is provided, including: a housing, including first and second compartments; a blade holder, movably received within the first compartment; a blade storing carrier, detachably inserted in the second compartment, including a receiving portion for receiving at least one spare blade; an elastic unit, disposed between the housing and the blade storing carrier; and a locking mechanism, including a base body disposed to the housing, a movable member attached to the base body and movable between locking and release positions, a first engaging member disposed on the movable member and a second engaging member disposed on the receiving portion and releasably engagable with the first engaging member, when the is second engaging member is disengaged from the second engaging member, the elastic unit biases the receiving portion to eject the blade storing carrier.

10 Claims, 10 Drawing Sheets

UTILITY KNIFE

BACKGROUND OF THE INVENTION

Field of the Invention

The present invention relates to a utility knife.

Description of the Prior Art

Utility knife is shaped to be suitable for one-handed grasping, and commonly used to cut thin materials such as paper, tape, fabric, etc. Utility knife is usually used in the fields such as processing factories, warehouses. TWI309197 and TWM478597 each disclose this type of utility knife.

However, the blade storing carrier of the aforementioned utility knife used to store spare blades has shortcomings in practical use. For example, the blade storing carrier of TWI309197 is pivotally connected to and received within the housing, which is hard to be gripped to be open. The blade storing carrier of TWI309197 is connected to the housing in tight fitting; however, after being used for a long period, the blade storing carrier can disengage from the housing.

The present invention is, therefore, arisen to obviate or at least mitigate the above-mentioned disadvantages.

SUMMARY OF THE INVENTION

The main object of the present invention is to provide a utility knife which provides an auto-ejecting mechanism for a blade storing carrier, which is very convenient in use.

To achieve the above and other objects, the present invention provides a utility knife, including: a housing, including a first compartment and a second compartment; a blade holder, movably received within the first compartment, configured to carry and hold a blade; a blade storing carrier, detachably inserted in the second compartment in an assembling direction, including a receiving portion configured to receive at least one spare blade; an elastic unit, disposed between the housing and the blade storing carrier, biasing the receiving portion in a direction opposite to the assembling direction; and a locking mechanism, including a base body, a movable member, a first engaging member and a second engaging member, the base body being disposed to the housing, the movable member being attached to the base body and movable between a locking position and a release position, the first engaging member being disposed on the movable member, the second engaging member being disposed on the receiving portion, one of the first engaging member and the second engaging member including a slot, the other of the first engaging member and the second engaging member including a projection which is releasably engaged within the slot, when the projection is engaged within the slot, the movable member is located in the locking position, the receiving portion is positioned within the second compartment, when the projection is disengaged from the slot, the movable member is located in the release position, and the elastic unit biases the receiving portion in a direction opposite to the assembling direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
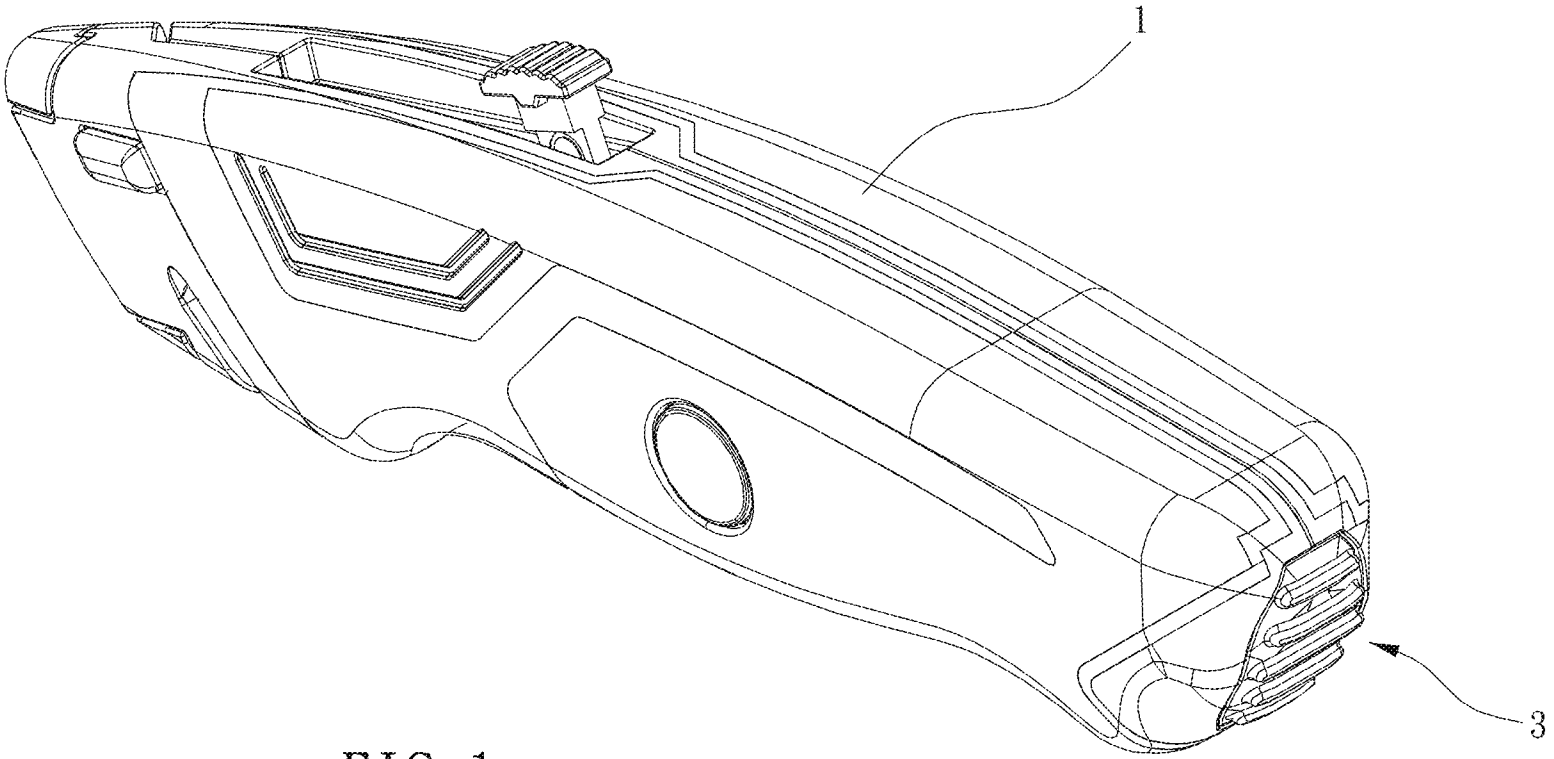
FIG. 1 is a stereogram of a preferable embodiment of the present invention.
Figure 2:
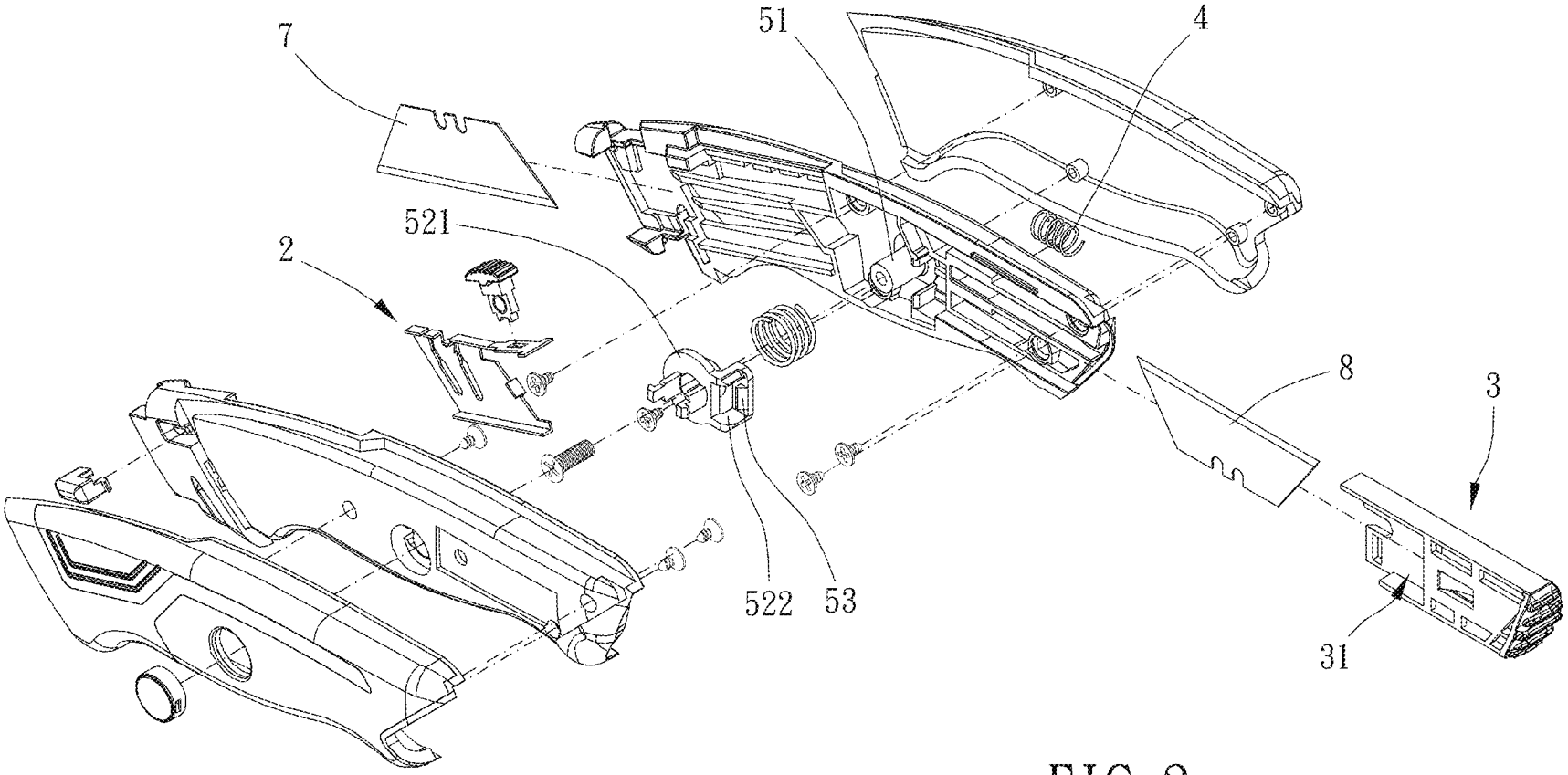
FIG. 2 is a breakdown drawing of FIG. 1.
Figure 3:
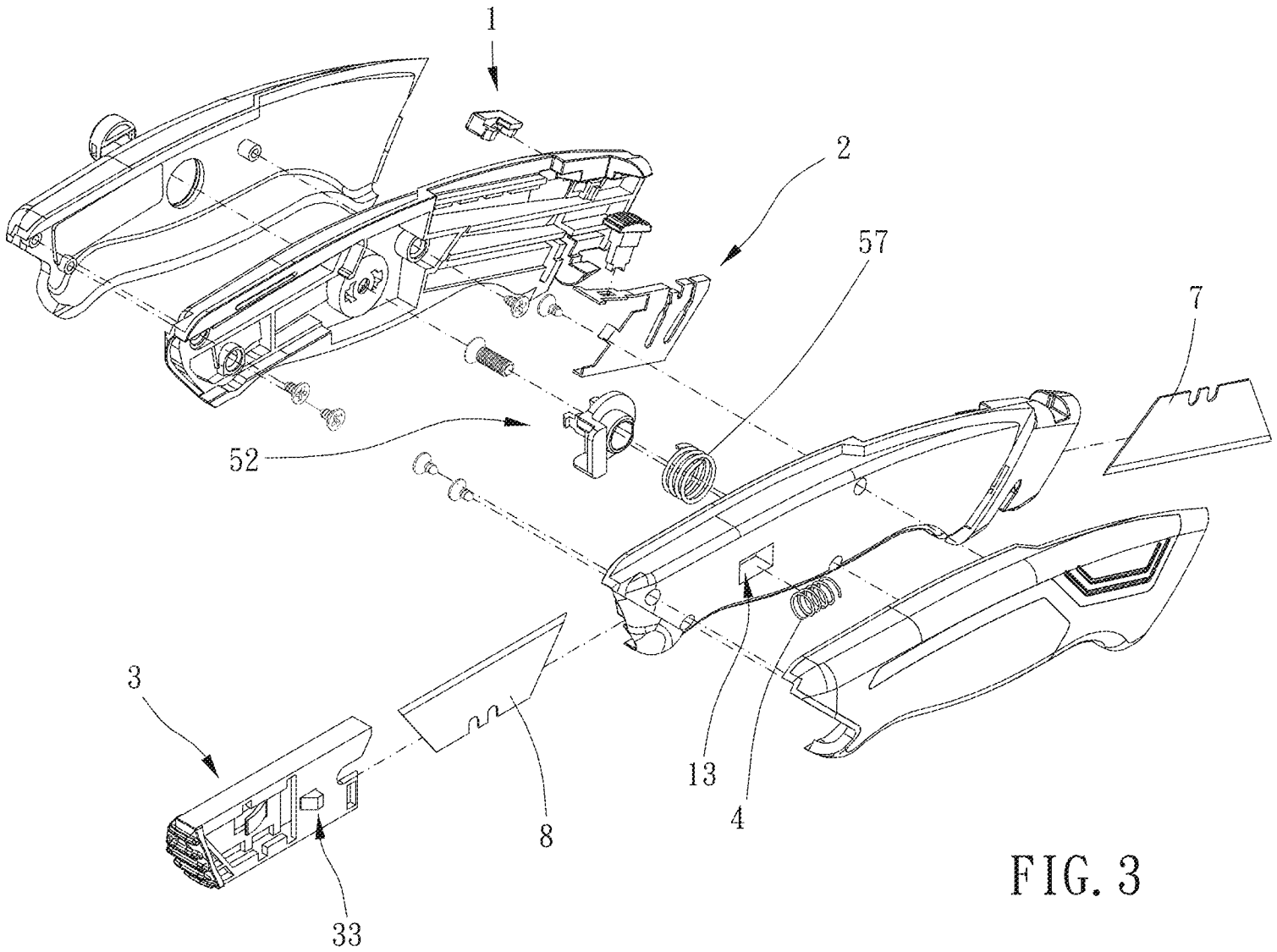
FIG. 3 is another breakdown drawing of FIG. 1.
Figure 4:
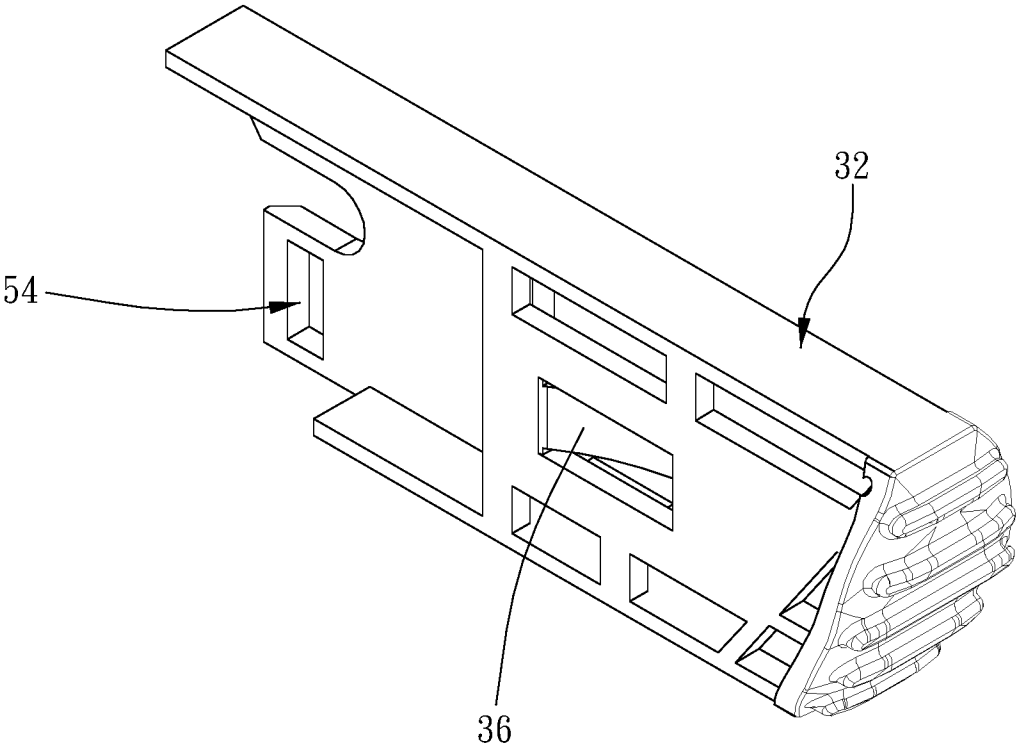
FIG. 4 is a stereogram showing a blade storing carrier of a preferable embodiment of the present invention.
Figure 5:
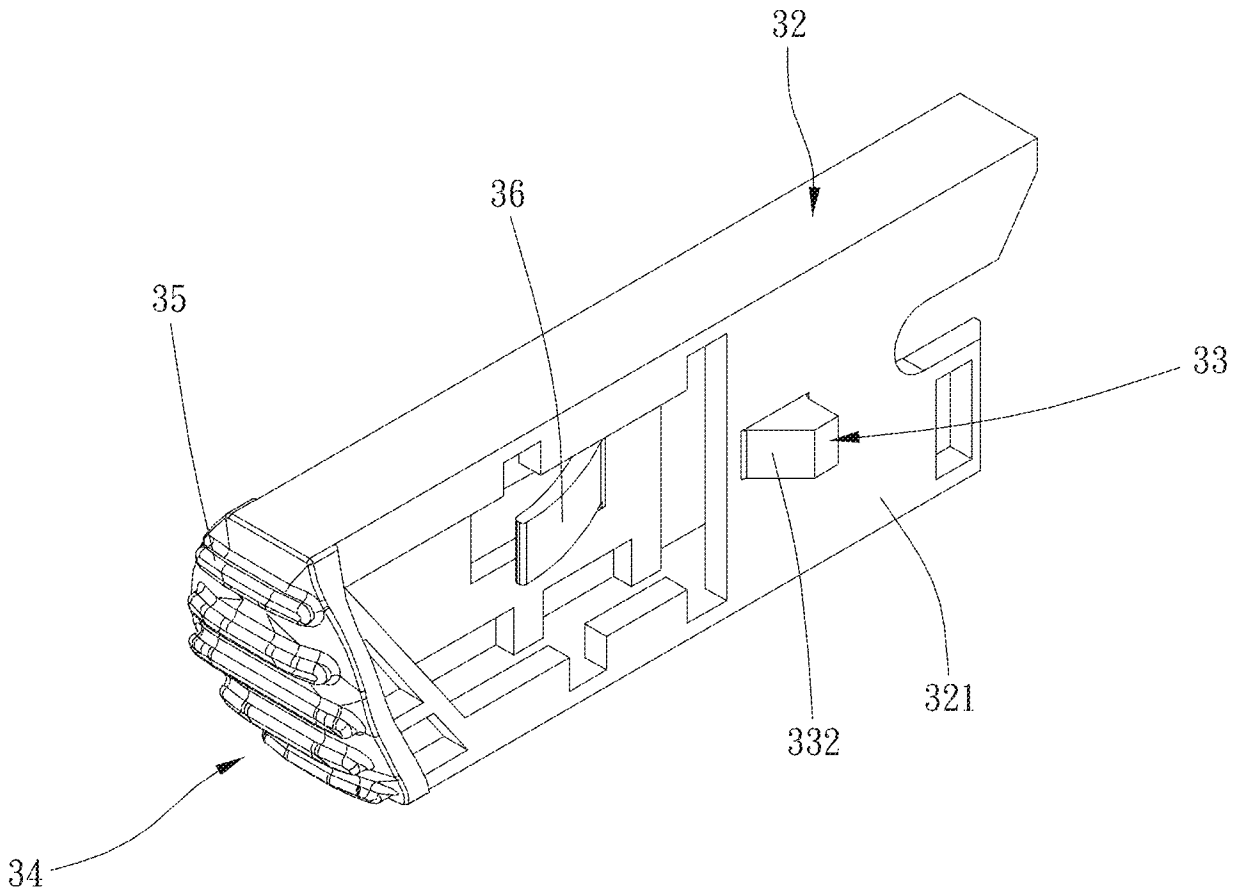
FIG. 5 is another stereogram showing the blade storing carrier of a preferable embodiment of the present invention.
Figure 6:
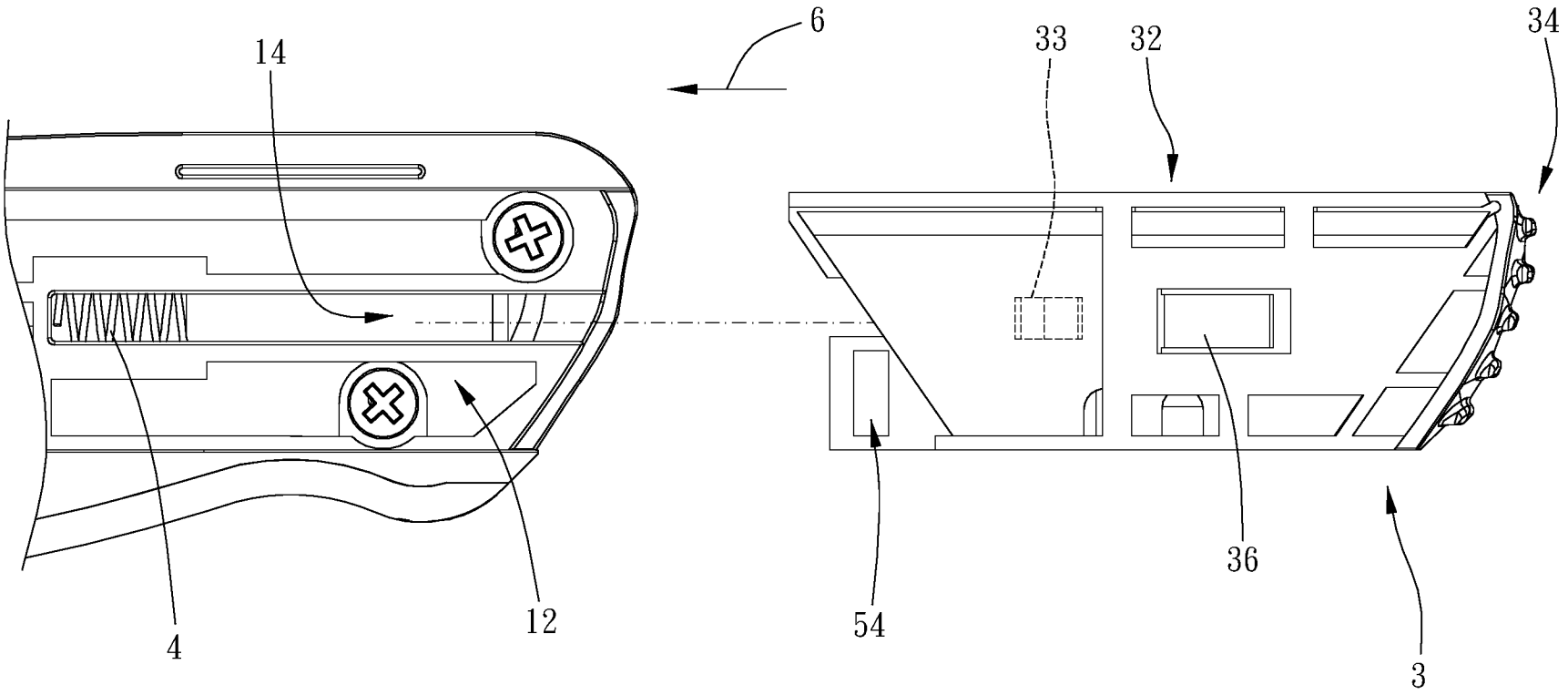
FIG. 6 is a drawing showing insertion of the blade storing carrier into a second compartment of a preferable embodiment of the present invention.
Figure 7:
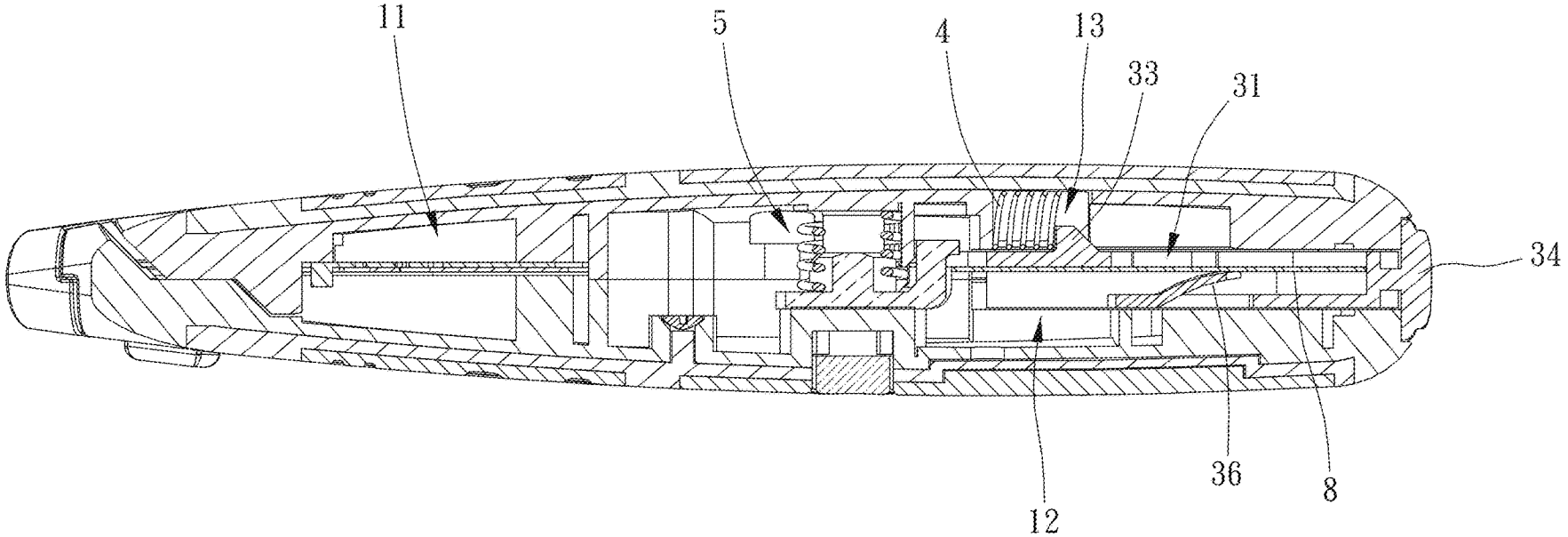
FIG. 7 is a cross-sectional view showing the blade storing carrier being inserted in the second compartment of a preferable embodiment of the present invention.
Figure 8:
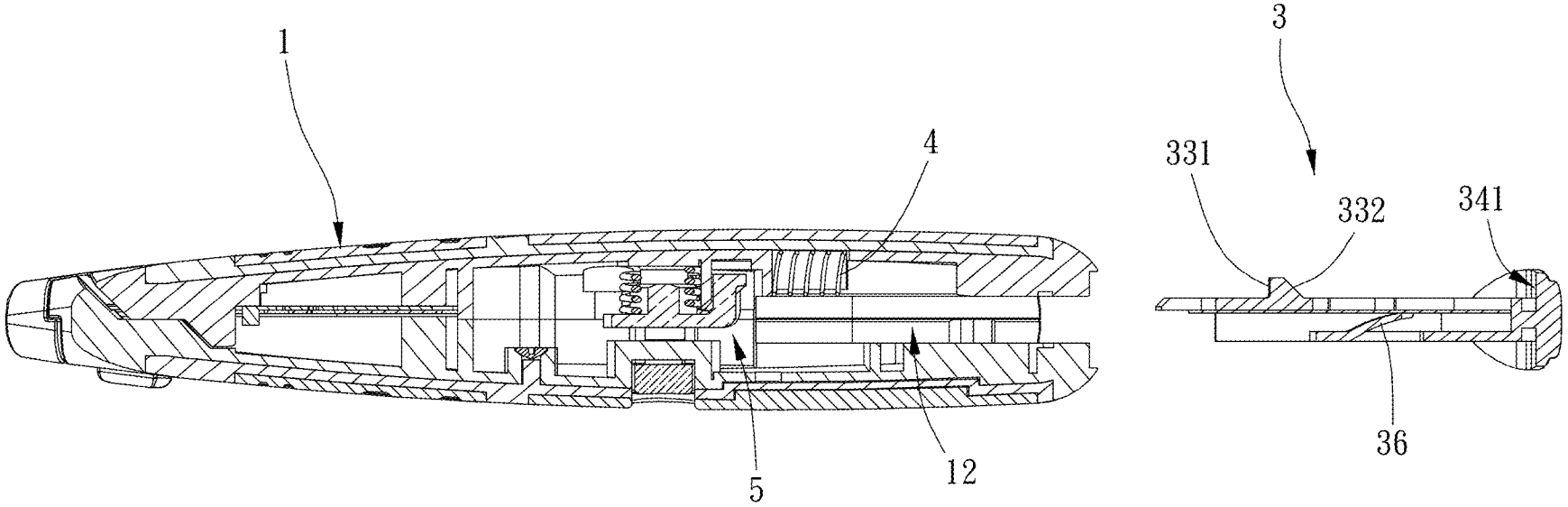
FIG. 8 is a cross-sectional view showing the blade storing carrier being detached from the second compartment of a preferable embodiment of the present invention.
Figure 9:
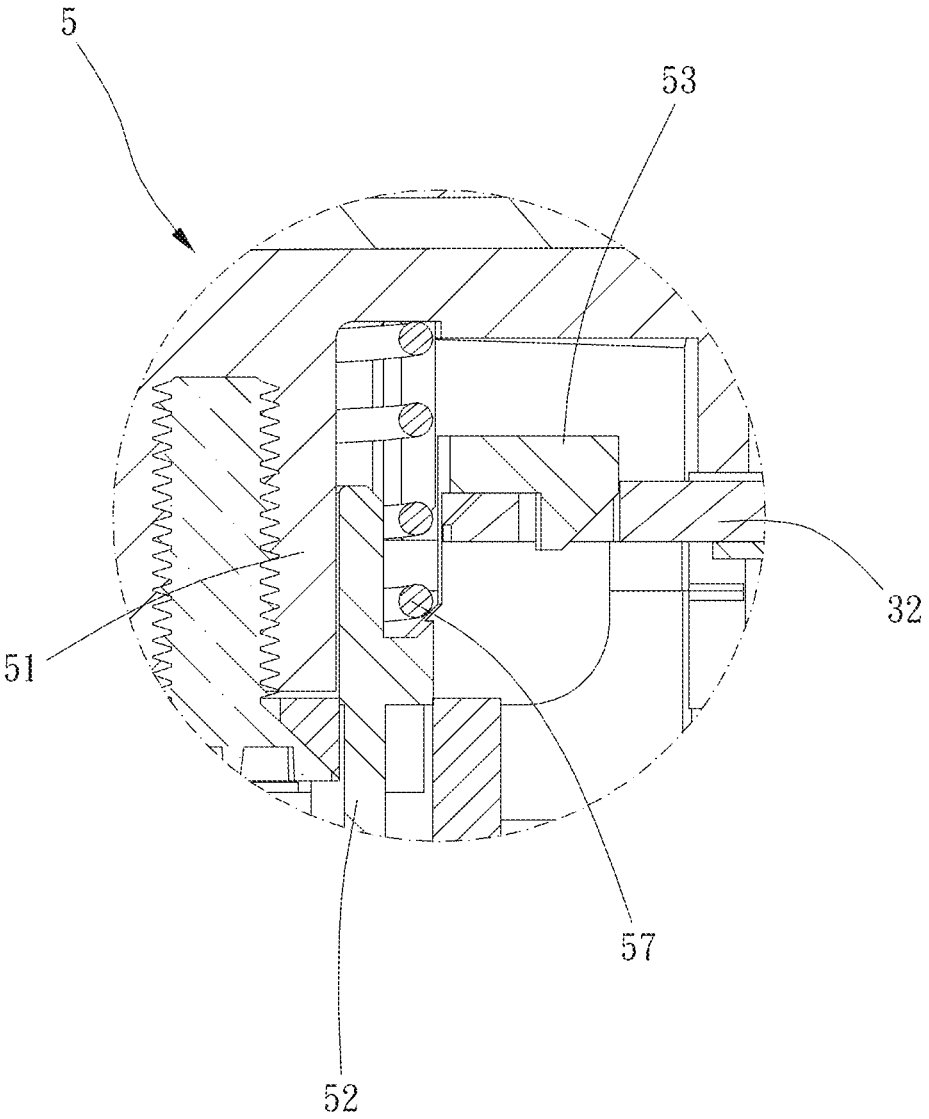
FIG. 9 is a drawing showing a movable member located in a locking position according to a preferable embodiment of the present invention.
Figure 10:
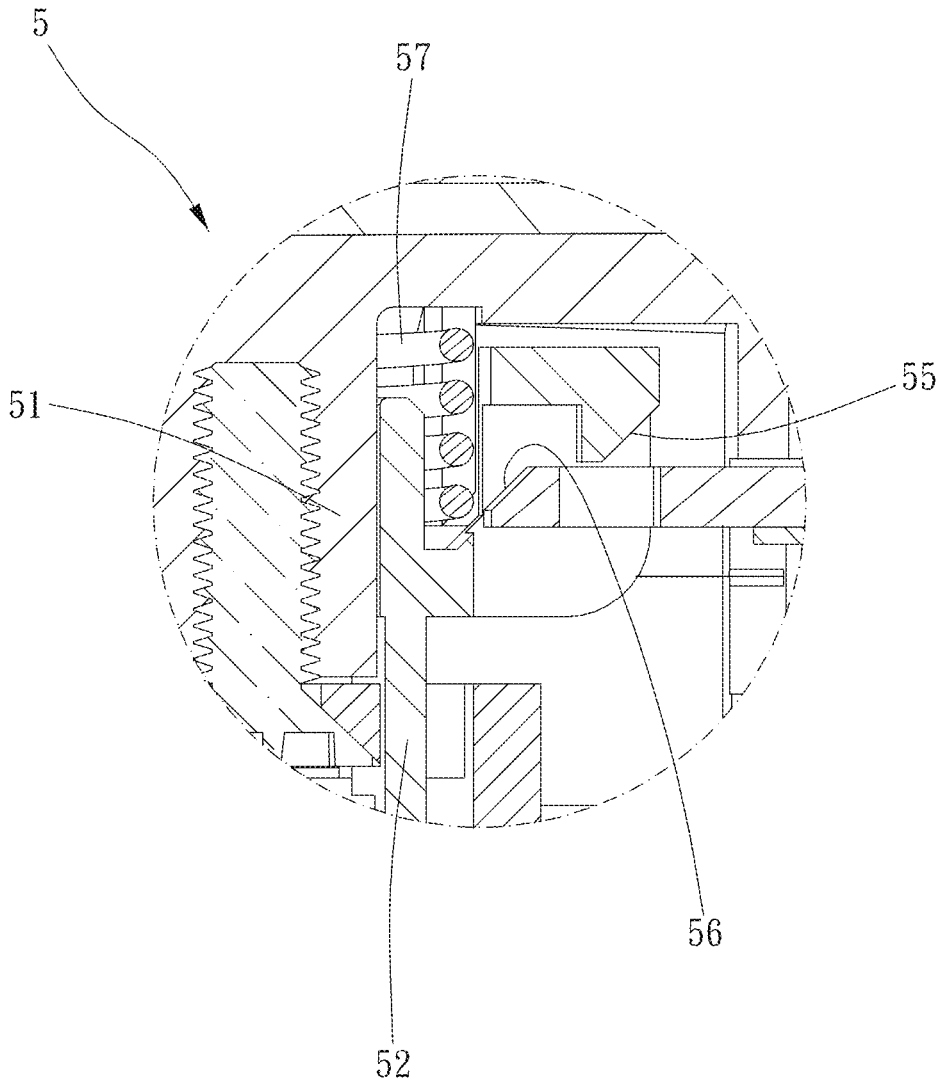
FIG. 10 is a drawing showing the movable member located in a release position according to a preferable embodiment of the present invention.

Please refer to FIGS. 1 to 10 for a preferable embodiment of the present invention. A utility knife of the present invention includes a housing 1, a blade holder 2, a blade storing carrier 3, an elastic unit 4, and a locking mechanism 5.

The housing 1 includes a first compartment 11 and a second compartment 12. The blade holder 2 is movably received within the first compartment 11, and the blade holder 2 is configured to carry and hold a blade 7. The blade storing carrier 3 is detachably inserted in the second compartment 12 in an assembling direction 6. The blade storing carrier 3 includes a receiving portion 31 configured to receive at least one spare blade 8. The elastic unit 4 is disposed between the housing 1 and the receiving portion 31 and biases the receiving portion 31 in a direction opposite to the assembling direction 6.

The locking mechanism 5 includes a base body 51, a movable member 52, a first engaging member 53 and a second engaging member 54. The base body 51 is disposed to the housing 1, and the movable member 52 is attached to the base body 51 and movable between a locking position and a release position. The first engaging member 53 is disposed on the movable member 52, and the second engaging member 54 is disposed on the receiving portion 31. One of the first engaging member 53 and the second engaging member 54 includes a slot, and the other of the first engaging member 53 and the second engaging member 54 includes a projection which is releasably engaged within the slot. For example, in this embodiment, the first engaging member 53 includes the projection, and the second engaging member 54 includes the slot.

When the blade storing carrier 3 is inserted in the second compartment 12 and the projection is engaged within the slot, the movable member 52 is located in the locking position, the projection is positioned within the slot so that the receiving portion 31 can be stably restricted within the second compartment 12. When projection is disengaged from the slot, the movable member 52 is located in the release position, and the elastic unit 4 biases the receiving portion 31 in a direction opposite to the assembling direction 6 so that the blade storing carrier 3 projects out beyond the housing 1, which provides an auto-releasing mechanism for the blade storing carrier 3.

Specifically, the housing 1 further includes a third compartment 13, and the third compartment 13 is in communication with the second compartment 12. The elastic unit 4 is retractably restricted in the third compartment 13. The receiving portion 31 includes a main body 32 and a connection portion 33 connected with the main body 32. The second engaging member 54 is disposed on the main body 32. When the main body 32 is located in the second compartment 12, the connection portion 33 projects within the third compartment 13 and urges the elastic unit 4. Specifically, the housing 1 further includes a groove 14, the groove 14 extends along the assembling direction 6 and is in communication with the third compartment 13. The groove 14 is in communication with the second compartment 12 in a direction perpendicular to the assembling direction 6. The connection portion 33 is protrusive relative to the main body 32 in a direction perpendicular to the assembling direction 6. The main body 32 is slidably disposed within the second compartment 12, and the connection portion 33 is slidably disposed within the groove 14 and movable to be within the third compartment 13 to urge the elastic unit 4.

In other embodiments, the elastic unit may be connected with the receiving portion and abutted against the housing; or, the elastic unit may projects from a wall of the second compartment and abutted against the blade storing carrier.

In this embodiment, the connection portion 33 is protrusive relative to a side 321 of the main body 32, and the connection portion 33 includes a first face 331 and a second face 332 in the assembling direction 6. The first face 331 faces the elastic unit 4 and is configured to abut the elastic unit 4, and the second face 332 faces in a direction away from the elastic unit 4. In the assembling direction 6 toward the side 321 of the main body 32, the distance between the first face 331 and the second face 332 increases. In other words, a portion of the connection portion 33 near the side 321 has a relatively larger thickness, which has good structural strength.

The blade storing carrier 3 further includes a cover 34, the cover 34 is connected with the receiving portion 31, and in a direction perpendicular to the assembling direction 6 the cover 34 is partially protrusive relative to the receiving portion 31 to form at least one wing 341. When the projection is engaged within the slot, the cover 34 covers the second compartment 12 and the at least one wing 341 contacts the housing 1 in the assembling direction 6. As the movable member 52 is located in the release position and the blade storing carrier 3 moves away from the housing 1, a space between the at least one wing 341 and the receiving portion 31 is provided for fingers to grip the at least one wing 341 to withdraw the blade storing carrier 3 from the housing 1.

Preferably, the blade storing carrier 3 further includes a plurality of ribs 35 disposed on a side of the cover 34 remote from the receiving portion 31, wherein the plurality of ribs 35 facilitate effective gripping.

Preferably, the blade storing carrier 3 further includes an urging portion 36 connected with the receiving portion 31, and part of the urging portion 36 is configured to urge the at least one spare blade 8, which effectively stabilizes the at least one spare blade 8. In this embodiment, the urging portion 36 is a curved sheet which is resiliently deformable, which provides suitable urging force on the at least one spare blade 8 in accordance with insertion/withdrawal of the at least one spare blade 8.

In this embodiment, the locking mechanism 5 is released by pressing the movable member 52. Specifically, the movable member 52 is slidably sleeved on the base body 51, and the movable member 52 is slidable in a direction perpendicular to the assembling direction 6; the movable member 52 further includes a sleeve 521 and two arm portions 522, the sleeve 521 is sleeved on the base body 51, the two arm portions 522 are separately disposed on the sleeve 521, and the first engaging member 53 is connected between the two arm portions 522.

Specifically, the locking mechanism 5 further includes a resilient member 57, and the resilient member 57 is sleeved on the base body 51 and abutted between the housing 1 and the movable member 52. When the movable member 52 is pressed by an external force to compress the resilient member 57, the movable member 52 is located in the release position. When the external force is removed, the resilient member 57 drives the movable member 52 to return to be located in the locking position so that the movable member 52 is kept in the locking position.

Preferably, the locking mechanism 5 further includes a first inclined portion 55 and a second inclined portion 56, the first inclined portion 55 is disposed on the movable member 52, and the second inclined portion 56 is disposed on the blade storing carrier 3. The first inclined portion 55 faces toward a direction away from the first compartment 11, and the second inclined portion 56 faces toward the first compartment 11. During insertion of the blade storing carrier 3 into the second compartment 12 in the assembling direction 6, the first inclined portion 55 and the second inclined portion 56 contact and relatively slide with each other so that the movable member 52 is driven to move toward the release position. As a result, the blade storing carrier 3 can be automatically locked as long as the blade storing carrier 3 is inserted in the second compartment 12 in the assembling direction 6.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A utility knife, including:

a housing, including a first compartment and a second compartment;

a blade holder, movably received within the first compartment, configured to carry and hold a blade;

a blade storing carrier, detachably inserted in the second compartment in an assembling direction, including a receiving portion configured to receive at least one spare blade;

an elastic unit, disposed between the housing and the blade storing carrier, biasing the receiving portion in a direction opposite to the assembling direction; and a locking mechanism, including a base body, a movable member, a first engaging member and a second engaging member, the base body being disposed to the housing, the movable member being attached to the base body and movable between a locking position and a release position, the first engaging member being disposed on the movable member, the second engaging member being disposed on the receiving portion, one of the first engaging member and the second engaging member including a slot, the other of the first engaging member and the second engaging member including a projection which is releasably engaged within the slot, when the projection is engaged within the slot, the movable member is located in the locking position, the receiving portion is positioned within the second compartment, when the projection is disengaged from the slot, the movable member is located in the release position, and the elastic unit biases the receiving portion in a direction opposite to the assembling direction.

2. The utility knife of claim 1, wherein the housing further includes a third compartment, the third compartment is in communication with the second compartment, the elastic unit is retractably restricted in the third compartment, the receiving portion includes a main body and a connection portion connected with the main body, the second engaging member is disposed on the main body, and when the main body is located in the second compartment, the connection portion projects within the third compartment and urges the elastic unit.

3. The utility knife of claim 2, wherein the housing further includes a groove, the groove extends along the assembling direction and is in communication with the third compartment, the groove is in communication with the second compartment in a direction perpendicular to the assembling direction, the connection portion is protrusive relative to the main body in a direction perpendicular to the assembling direction, the main body is slidably disposed within the second compartment, and the connection portion is slidably disposed within the groove and movable to be within the third compartment to urge the elastic unit.

4. The utility knife of claim 3, wherein the connection portion is protrusive relative to a side of the main body, the connection portion includes a first face and a second face in the assembling direction, the first face faces the elastic unit and is configured to abut the elastic unit, the second face faces in a direction away from the elastic unit; and in the assembling direction toward the side of the main body, the distance between the first face and the second face increases.

5. The utility knife of claim 4, wherein the blade storing carrier further includes a cover, the cover is connected with the receiving portion, in a direction perpendicular to the assembling direction the cover is partially protrusive relative to the receiving portion to form at least one wing, and when the projection is engaged within the slot, the cover covers the second compartment and the at least one wing contacts the housing in the assembling direction; the blade storing carrier further includes a plurality of ribs disposed on a side of the cover remote from the receiving portion; the locking mechanism further includes a resilient member, the resilient member is sleeved on the base body and abutted between the housing and the movable member, when the movable member is pressed by an external force to compress the resilient member, the movable member is located in the release position, and when the external force is removed, the resilient member drives the movable member to return to be located in the locking position; the blade storing carrier further includes an urging portion connected with the receiving portion, and part of the urging portion is configured to urge the at least one spare blade; the urging portion is a curved sheet which is resiliently deformable; the movable member is slidably sleeved on the base body, the movable member is slidable in a direction perpendicular to the assembling direction; the first engaging member includes the projection, the second engaging member includes the slot; the movable member further includes a sleeve and two arm portions, the sleeve is sleeved on the base body, the two arm portions are separately disposed on the sleeve, the first engaging member is connected between the two arm portions; the locking mechanism further includes a first inclined portion and a second inclined portion, the first inclined portion is disposed on the movable member, the second inclined portion is disposed on the blade storing carrier, the first inclined portion faces toward a direction away from the first compartment, the second inclined portion faces toward the first compartment, and during insertion of the blade storing carrier into the second compartment in the assembling direction, the first inclined portion and the second inclined portion contact and relatively slide with each other so that the movable member is driven to move toward the release position.

6. The utility knife of claim 1, wherein the blade storing carrier further includes a cover, the cover is connected with the receiving portion, in a direction perpendicular to the assembling direction the cover is partially protrusive relative to the receiving portion to form at least one wing, and when the projection is engaged within the slot, the cover covers the second compartment and the at least one wing contacts the housing in the assembling direction.

7. The utility knife of claim 6, wherein the blade storing carrier further includes a plurality of ribs disposed on a side of the cover remote from the receiving portion.

8. The utility knife of claim 1, wherein the locking mechanism further includes a resilient member, the resilient member is sleeved on the base body and abutted between the housing and the movable member, when the movable member is pressed by an external force to compress the resilient member, the movable member is located in the release position, and when the external force is removed, the resilient member drives the movable member to return to be located in the locking position.

9. The utility knife of claim 1, wherein the blade storing carrier further includes an urging portion connected with the receiving portion, and part of the urging portion is configured to urge the at least one spare blade.

10. The utility knife of claim 9, wherein the urging portion is a curved sheet which is resiliently deformable.

* * * * *